US005314127A

United States Patent [19]

Coulthard

[11] Patent Number: 5,314,127

[45] Date of Patent: May 24, 1994

[54] INFECTIOUS WASTE FEED SYSTEM

[75] Inventor: E. James Coulthard, York, Pa.

[73] Assignee: Donlee Technologies, Inc., York, Pa.

[21] Appl. No.: 8,514

[22] Filed: Jan. 25, 1993

[51] Int. Cl.[5] ..... F23K 1/00; B02C 1/08

[52] U.S. Cl. ..... 241/222; 110/222

[58] Field of Search ..... 241/222, 224, 236, 31, 241/DIG. 38, 60, 186.2, 186.4, 225; 110/110, 222, 346

[56] References Cited

U.S. PATENT DOCUMENTS 1,385,674 7/1921 Fraser ..... 241/60 X 2,532,318 12/1950 Mackey et al. ..... 241/60 X 5,022,328 6/1991 Robertson ..... 110/222

*Primary Examiner*—Douglas D. Watts

*Attorney, Agent, or Firm*—Finnegan, Henderson, Farabow, Garrett & Dunner

[57] ABSTRACT

An infectious waste feed system for comminuting infectious waste and feeding the comminuted waste to a combustor automatically without the need for human intervention. The system includes a receptacle for accepting waste materials. Preferably, the receptacle includes a first and second compartment and a means for sealing the first and second compartments from the atmosphere. A shredder is disposed to comminute waste materials accepted in the receptacle to a predetermined size. A trough is disposed to receive the comminuted waste materials from the shredder. A feeding means is disposed within the trough and is movable in a first and second direction for feeding the comminuted waste materials to a combustor.

20 Claims, 2 Drawing Sheets

INFECTIOUS WASTE FEED SYSTEM

BACKGROUND OF THE INVENTION

1. Field of the Invention

The present invention relates to a waste feed system and, more particularly, to an infectious waste feed system for feeding infectious waste materials, such as hospital waste, to a combustor.

2. Description of the Related Art

Infectious waste can be defined as that waste which, unless processed, disposed, stored, collected or transported with caution, is or may be contaminated by disease-producing microorganisms or may harm or threaten human health. The term infectious waste includes, among others, the following types of waste: waste generated by hospitalized patients who are isolated, or on blood and body fluid precautions in order to protect others from their communicable disease; cultures and stocks of etiologic agents; animal waste blood and animal blood products which are known or suspected to contain contagious zoonotic pathogens, and human waste blood and blood products; tissues, organs, body parts, blood, and body fluids that are removed during surgery and autopsies; wastes that were in contact with pathogens in any type of laboratory work; carcasses and body parts of animals exposed to contagious zoonotic pathogens; waste biologicals, for example vaccines, produced by pharmaceutical companies for human or veterinary use; and food or other products or equipment that is discarded because of contamination with etiologic agents.

Many of the above types of infectious wastes are generated at hospital sites. Hospitals are currently experiencing much difficulty in properly disposing of this waste. This is, in part, because the waste generated at the hospital sites includes a variety of constituents having different moisture contents and densities.

By its nature, hospital waste is a material that is difficult to handle and feed by mechanical means because of its extremely heterogeneous and possibly wet and sticky nature. The problems of handling and feeding such waste are exacerbated by the potential of the waste to be infectious and/or toxic. While incineration in a fluidized bed combustor is technically feasible and has a number of advantages, the waste must first be reduced in size to avoid problems in the fluidized bed such as de-fluidization, bed material agglomeration, disruption to combustion air and fuel distribution, and poor combustion.

A critical area in the incineration process for infectious hospital waste in a fluidized bed combustor is the ability to safely and reliably feed the waste into the combustor. The feed system must be able to properly handle the waste without creating atmospheric contamination and without posing undue health risks to operators. Relevant Pennsylvania codes require that compactors, grinders, or similar comminuting devices may not be used to reduce the volume of infectious waste before the waste has been rendered non-infectious. Therefore, the waste must reach any incinerator in a sealed container. However, for effective destruction in the fluidized bed, size reduction to two inches, or possibly smaller, is desired. In order to comply with the regulations and yet provide sized waste materials that are acceptable for incineration in a fluidized bed, it is necessary to have a waste feed system, including a size reduction system, which is an integral component of the combustor both in terms of mechanical attachment and control systems. Thus, after the waste has entered the feed/size reduction system, the process should be fully automatic and further human intervention or contact should not be required.

Accordingly, it is an object of the present invention to provide a waste feed system that is an integral component of a combustor, both in terms of mechanical attachment and control systems.

It is another object of the present invention to provide a waste feed system that is fully automatic and interconnected with the combustor so that human intervention or contact is not necessary after the waste has entered the waste feed system.

It is yet another object of the present invention to provide a waste feed system that controls the rate at which waste is introduced into the combustor and that prevents the emission of toxic substances.

Still another object of the present invention is to provide a cost-effective and reliable apparatus which does not cause atmospheric contamination or pose undue health risks to operators.

Additional object and advantages of the invention will be set forth in the description which follows, and in part will be obvious from the description or may be learned by practice of the invention. The objects and advantages of the invention may be realized and attained by means of the instrumentalities and combinations particularly pointed out in the appended claims.

SUMMARY OF THE INVENTION

To achieve the foregoing objects, and in accordance with the invention as embodied and broadly described herein, there is provided an infectious waste feed system that includes a receptacle for accepting waste materials. A comminuting means is provided for comminuting the waste materials to a predetermined size, the comminuting means being disposed to comminute waste materials accepted in the receptacle. A trough is disposed to receive the comminuted waste materials, and a feeding means is disposed within the trough for feeding the comminuted waste materials to a combustor.

Preferably, the receptacle includes a first and second compartment, and a means for sealing the first and second compartments. It is contemplated that the waste feed system of the present invention will be operated under negative pressure to prevent leakage of contaminated air into the atmosphere. Also, the waste feed system of the present invention preferably includes a means for sterilizing the first and second compartments and the trough in the event that human contact is necessary for purposes such as maintenance.

BRIEF DESCRIPTION OF THE DRAWINGS

The accompanying drawings, which are incorporated in and constitute a part of the specification, illustrate preferred embodiments of the invention and, together with the general description provided above and the detailed description of the preferred embodiments provided below, serve to explain the principles of the invention.

DESCRIPTION OF THE PREFERRED EMBODIMENTS

Figure 2:
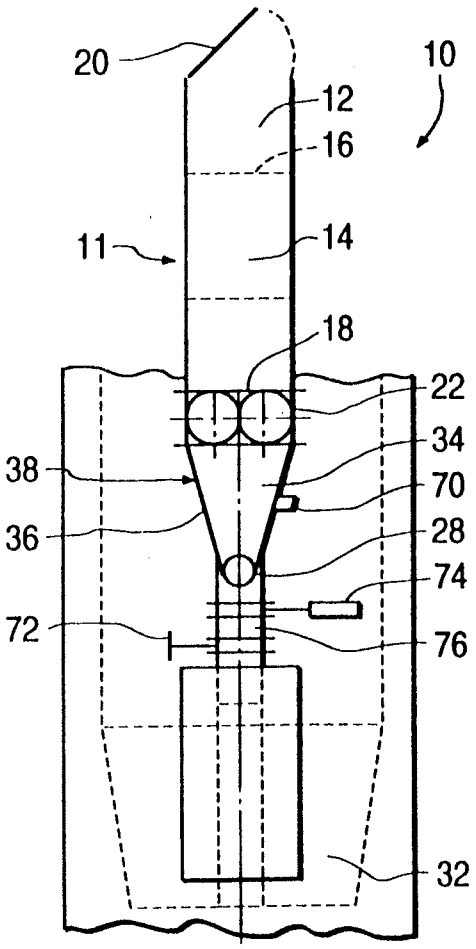
FIG. 2 is a partially pictorial and partially schematic end illustration of the apparatus depicted in FIG. 1.
Figure 1:
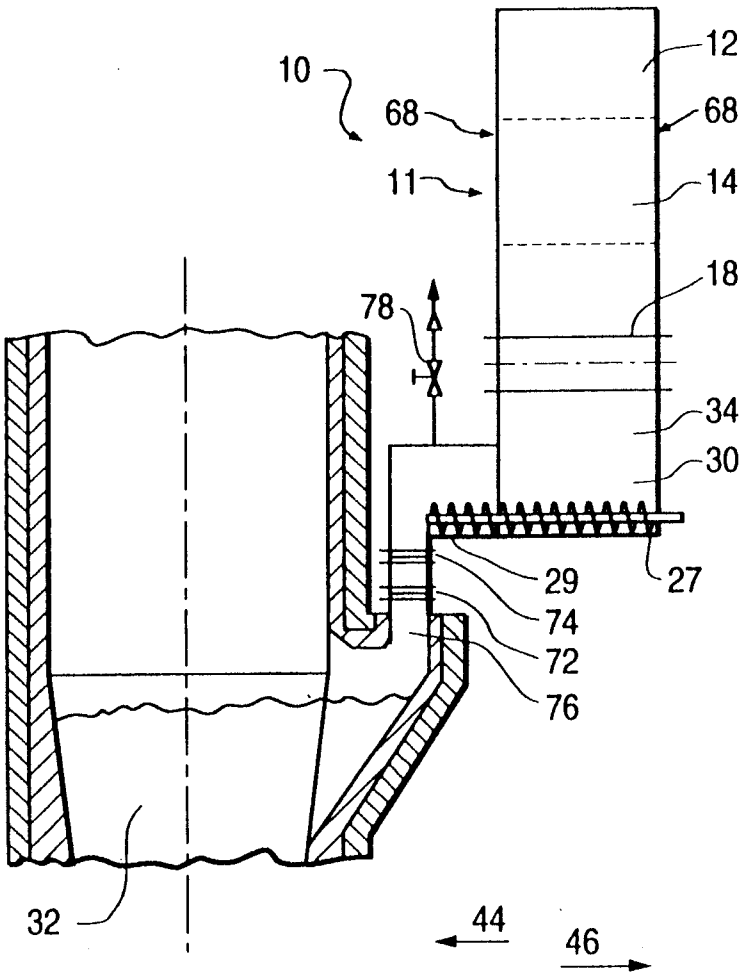
FIG. 1 is a partially pictorial and partially schematic side illustration of a presently preferred embodiment of an apparatus incorporating the teachings of the present invention.

Reference will now be made in detail to the present preferred embodiment of the invention as illustrated in FIGS. 1 and 2 and a second embodiment illustrated in FIGS. 3 and 4.

The apparatus shown in the accompanying drawings is designated generally by the reference numeral 10. Such an apparatus comminutes infectious waste and feeds the comminuted waste to a combustor automatically without the need for human intervention. The common elements of the apparatus depicted in FIGS. 1 and 2 and the apparatus depicted in FIGS. 3 and 4 are designated with the same reference character.

In accordance with the present invention, the infectious waste feed system includes a receptacle for accepting waste materials. As embodied herein, infectious waste feed system 10 includes receptacle 11 for accepting waste materials. It is contemplated that a conveyer (not shown) will deliver the waste material into receptacle 11. Preferably, receptacle 11 includes first and second compartments 12 and 14, respectively.

Preferably, feed system 10 includes a means for sealing the first and second compartments from the atmosphere. As embodied herein, an access door 20 is positioned at the top of first compartment 12 and a drop gate 16 is positioned at the top of second compartment 14. Thus, first and second compartments 12 and 14 are effectively sealed from the outside environment and the other components of feed system 10.

In the presently preferred embodiment depicted in FIGS. 1 and 2, it is expected that feed system 10 will be maintained under negative pressure by a fan (not shown) that is part of the overall combustion system. Maintaining the system under negative pressure will prevent leakage of contaminated air into the atmosphere.

Figure 4:
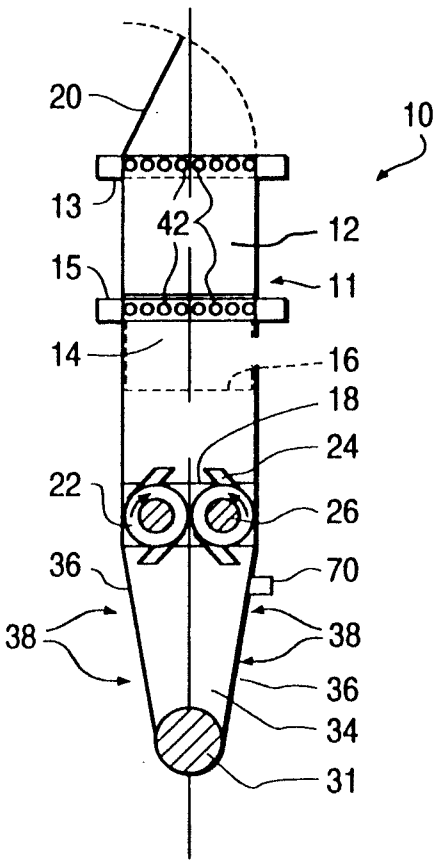
FIG. 4 is a partially pictorial and partially schematic end illustration of the apparatus depicted in FIG. 3.
Figure 3:
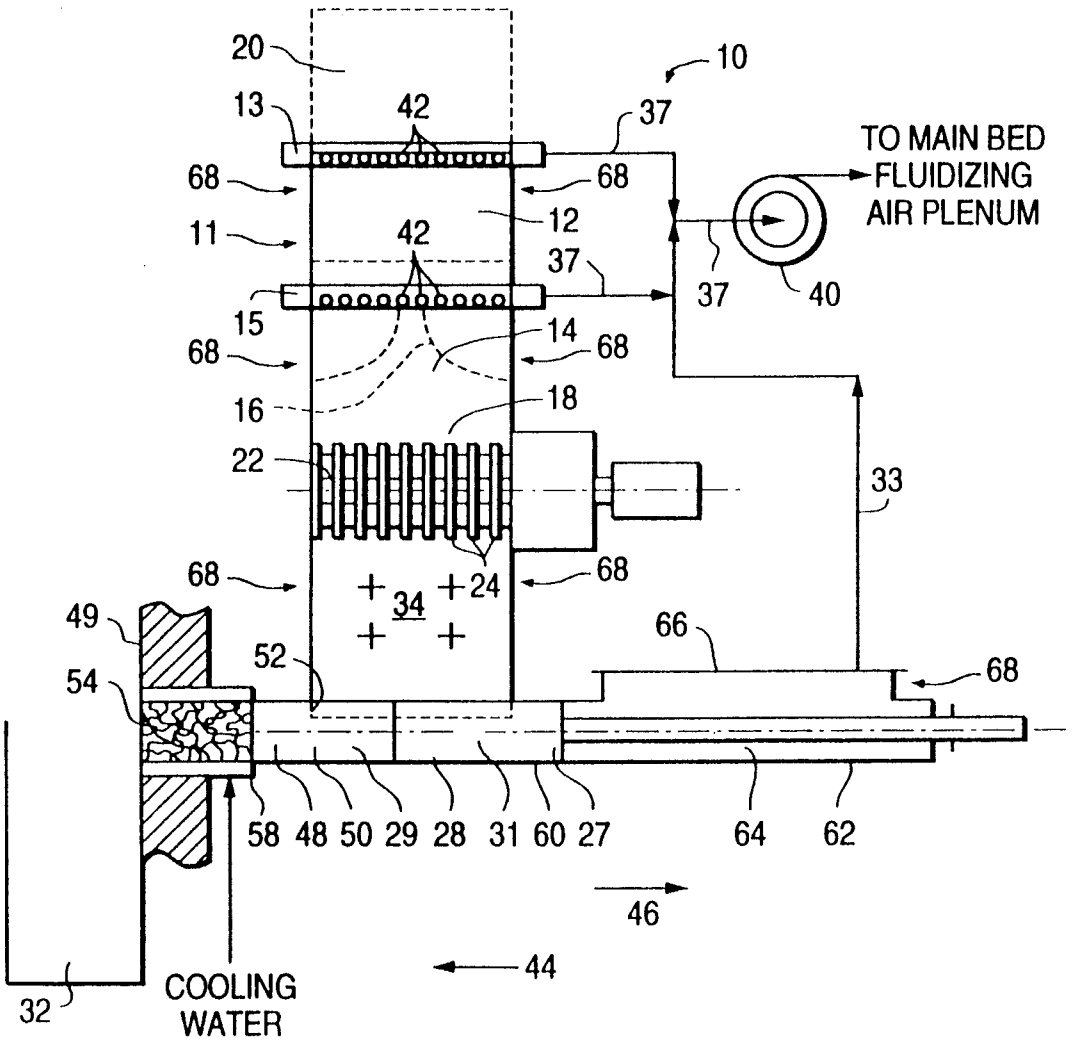
FIG. 3 is a partially pictorial and partially schematic side illustration of a second embodiment of an apparatus incorporating the teachings of the present invention.

In the second embodiment depicted in FIGS. 3 and 4, a separate system is provided to maintain negative pressure throughout feed system 10. As shown in FIG. 3, suction manifolds 13 and 15 may be provided around the perimeter of first compartment 12 and second compartment 14, respectively. The second embodiment includes an exhaust fan 40 that is provided to draw air from compartments 12 and 14 via a series of holes 42 drilled through the compartment walls into suction manifolds 13 and 15 and through lines 37. Proper distribution of air withdrawal is effected by employing the full perimeter of the compartments. Exhaust fan 40 discharges air into the main fluidized bed (not shown) of a combustor 32, for destruction of possible contaminants. Exhaust fan 40 and suction manifolds 13 and 15 are preferably designed such that when the top access door 20 is open, clean ambient air is drawn into first compartment 12 to protect the operator and the environment while waste is being loaded into receptacle 11. A purge line (not shown) may be utilized in connection with exhaust fan 40 to prevent leakage of possible contaminated air from the fan shaft seal.

In accordance with the present invention, the waste feed system 10 includes means for comminuting the waste materials to a predetermined size. The comminuting means is disposed to comminute waste materials accepted in the receptacle. As embodied herein, a rotary shear type shredder 22 comminutes the waste materials accepted in receptacle 11 to a size of about two inches or smaller. Such sized waste is effective for combustion in a fluidized bed combustor. As shown in FIG. 4, shredder 22 includes rotating shafts 26 and blades 24. After the shredder 22 is started, comminuting of the materials is accomplished as the materials are drawn through the interfaces of the blades 24 and rotating shafts 26. It is the close tolerance of blades 24 that perform the shearing action. A shredder compartment 18 houses shredder 22. It is contemplated that in certain applications a suction manifold (not shown) may surround shredder compartment 18 to draw off any contaminated air.

After the waste material has been dropped into shredder compartment 18, drop gate 16 is closed prior to starting shredder 22. This prevents the splashing of liquids or other substances into first compartment 12 to maintain the compartment clean for operator access. Typically, access door 20 is also closed prior to starting shredder 22. Access door 20 and drop gate 16 provide a double isolation between shredder compartment 18 and the outside environment. If necessary, a ram device (not shown) may be utilized in the receptacle to force the waste materials into the shredder. It is anticipated, however, that the force of gravity will be sufficient to feed waste materials to shredder 22.

Shredder 22 preferably includes an auto-reversing and a non-jamming capability. Should over-feeding occur, shredder 22 automatically detects it by an increase in motor amps. When the amperage reaches a preset level, the shredder shifts into a reversing mode to clean the cutting area. Shredder 22 then continues in the forward direction and will continue this process until the material has been shredded. Preferably, the unit has an automatic shutdown feature after three reversals. The auto-reversing and auto-shutdown features protect the machine from damage and thereby reduce downtime for repairs.

In accordance with the present invention, waste feed system 10 includes a trough 28 disposed to receive the comminuted waste materials. Trough 28 has a first end 27 and a second end 29. In the presently preferred embodiment shown in FIGS. 1 and 2, an auger 30 is disposed within trough 28 and is movable in a first and second direction within trough 28 for feeding comminuted waste materials to combustor 32. The auger 30 is a variable speed auger that regulates the rate of waste feed into combustor 32. As shown in FIG. 1, the first direction of auger 30 is indicated by the arrow 44 and the second direction of auger 30 is indicated by arrow 46. Auger 30 is preferably a slow speed auger designed to provide the required waste feed rate.

In the second embodiment depicted in FIGS. 3 and 4, a ram 31 is disposed within trough 28 and is also movable in the first and second directions indicated by arrows 44 and 46, respectively, within trough 28 for feeding comminuted waste materials to combustor 32. Ram 31 is preferably a slow speed ram designed to provide the required waste feed rate.

In this second embodiment, a feed duct 48 is positioned adjacent trough 28. It is contemplated that feed duct 48 may be water cooled. Feed duct 48 includes first end 50 directly adjacent second end 29 of trough 28 and a second end 49 directly adjacent combustor 32.

First end 50 of feed duct 48 includes a shear edge 52 to cut off any projecting waste materials as the material enters feed duct 48.

During normal operation of the second embodiment, ram 31 does not travel the full length of feed duct 48. Accordingly, a plug 54 accumulates in the feed duct. The plug acts as a positive seal between the hot contents of combustor 32 and the waste feed system 10. Water cooling of feed duct 48 reduces the temperature of second end 49 of feed duct 48, thereby preventing partial combustion and excessive sticking from occurring in the feed duct.

Ram 31 is designed to have multiple phases of operation. With reference to FIG. 3, ram 31 will first be retracted from the position indicated with reference numeral 58 at a controlled rate to expose trough 28 and allow comminuted material to fall into the trough. To accomplish this objective, ram 31 will be retracted to the position indicated with reference numeral 60. Once comminuted material accumulates in trough 28, ram 31 is moved in the direction indicated by reference character 44 to push the waste materials into combustor 32 at the desired feed rate. Ram 31 will typically come to rest at the position indicated by reference numeral 58. However, ram 31 also has the capacity to travel completely to the second end 49 of feed duct 48 in order to fully clear the duct 48 prior to shutdown of the combustor 32. Ram 31 also has the capability of being fully retracted to the position indicated by reference numeral 62. In the fully retracted position of ram 31, an end enclosure 64 accommodates the ram. The enclosure includes a removable cover 66 for easy access and cleaning. It is contemplated that end enclosure 64 may also be connected to exhaust fan 40 via line 33. The air in end enclosure 64 is displaced by movement of ram 31 at a rate not to exceed 10% of exhaust fan capacity. This permits a negative pressure to always be maintained inside end enclosure 64 thereby preventing escape of contaminated air.

In the presently preferred embodiment of FIGS. 1 and 2, a chute 76 connects the trough 28 with the combustor 32. The feed duct of the second embodiment is not utilized and a plug is not formed by the auger 30. To ensure that hot gases do not flow back into feed system 10 from combustor 32, in the embodiment of FIGS. 1 and 2, a manual, knife-gate isolation valve 72 and an automatic, knife-gate isolation valve 74 are provided in chute 76 between trough 28 and combustor 32. The pressure below knife-gate valves 72 and 74 is controlled at approximately −4 inches of water to create a minimal controlled leakage of air into feed system 10. Knife-gate valves 72 and 74 should be designed to withstand an operating temperature of at least 1000° F. and a pressure of approximately 50 inches of water. An emergency suction valve 78 is provided above chute 76 to ensure that a negative pressure is maintained in the system under possible abnormal fluidized bed operating conditions.

Preferably, a hopper 34 is disposed intermediate shredder 22 and trough 28 for receiving the waste materials comminuted by shredder 22. Hopper 34 includes inclined sides 36 to facilitate the passage of comminuted waste materials to trough 28. Hopper 34 also preferably includes compressed air jets 38 disposed in inclined sides 36 to prevent blockage of hopper 34. It is contemplated that compressed air jets 38 will provide air at approximately 50–100 p.s.i. Hopper 34 may also include a sensor 70 to determine when waste materials have accumulated to a predetermined level within hopper 34.

In the event that the exhaust system fails or personnel access to the waste feed system is necessary for equipment repair, inspection and/or maintenance, it is contemplated that a sterilizing system will be activated. Sterilizing system includes disinfectant atomizers 68 which may be provided inter alia, in first compartment 12, second compartment 14, shredder compartment 18, hopper 34, and end enclosure 64. The sterilizing system may also include high temperature steam nozzles. If exhaust fan 40 fails or if the internal system pressure exceeds a predetermined value, then the sterilization system will operate automatically. It will initiate an interlock on access door 20 and drop gate 16 so that they cannot be opened for a predetermined period of time. If access door 20 is opened when exhaust fan 40 fails, then an alarm (not shown) will sound and the first compartment 12 sterilizing system will be activated. The isolation provided by drop gate 16 will be relied upon for safety.

The waste feed system of the present invention is designed to be operated at a pressure of about −3 inches water gauge. Thus, clean ambient air will be drawn through any openings present in the apparatus. This negative pressure prevents the egress of possibly contaminated air from inside feed system 10 to the outside environment. The load imparted on access door 20 by virtue of the internal negative pressure requires that the door be mechanically operated.

The normal operating sequence of waste feed system 10 will now be described with reference to the second embodiment illustrated in FIGS. 3 and 4. When feed system 10 is in a "ready" condition, access door 20 and drop gate 16 are closed and shredder 22 is off. Ram 31 is in the position indicated with reference numeral 58. Additionally, air jets 38 and sterilization atomizers 8 are off.

When it is desired to initiate the operating sequence of feed system 10, access door 20 is opened and waste is placed in first compartment 12. Access door 20 is closed and drop gate 16 is opened. The waste will then drop into shredder compartment 18. After approximately 10 seconds, drop gate 16 is closed and shredder 22 is started.

Shredder 22 will continue to operate until the motor amps have dropped to a predetermined level and remained steady for about 30 seconds. Ram 31 is retracted to the position indicated with reference numeral 60 and compressed air jets 38 are activated for a predetermined time to facilitate passage of comminuted waste from shredder compartment 18 through hopper 34 into trough 28. To complete the normal operating sequence, ram 31 is moved from the position indicated by reference numeral 60 to the position indicated by reference numeral 58.

It is contemplated that access door 20 will be opened and closed by a single push button. It is also contemplated that upon closing of access door 20, the steps described in the preceding two paragraphs will be automatically initiated. An interlock may be provided on feed system 10 to prevent access door 20 from being opened if the main fuel feed rate to combustor 32 falls below a predetermined level or if combustor 32 is in any type of alarm mode.

It will be apparent to those skilled in the art that modifications and variations can be made in the waste feed system of the present invention. The invention in its broader aspect is, therefore, not limited to the specific details, representative apparatus, and illustrative examples shown and described above. Thus, it is intended that all matter contained in the foregoing description and shown in the accompanying drawings shall be interpreted as illustrative and not in a limiting sense.

I claim:

1. An infectious waste feed system for a combustor, the feed system comprising:

a receptacle for accepting waste materials;

means for comminuting the waste materials to a predetermined size, said comminuting means disposed to comminute waste materials accepted in the receptacle;

a trough disposed to receive the comminuted waste materials;

feeding means disposed within the trough, said feeding means being movable in a first and a second direction within the trough for feeding the comminuted waste materials to the combustor; and means for maintaining a negative pressure throughout the feed system to prevent the inadvertent egress of contaminated air.

2. The feed system of claim 1, wherein the receptacle includes a first and a second compartment and means for sealing the first and second compartments.

3. The feed system of claim 2, wherein the means for maintaining negative pressure includes means for drawing contaminated air from the first and second compartments to prevent accumulation and leakage of contaminated air.

4. The feed system of claim 3, wherein the means for drawing contaminated air includes a first and second suction manifold disposed around the perimeter of the first and second compartments, respectively, and an exhaust fan for drawing contaminated air from the first and second compartments through the first and second suction manifolds to a predetermined disposal site.

5. The feed system of claim 1, further comprising a hopper disposed intermediate the comminuting means and the trough for receiving the waste materials comminuted by the comminuting means.

6. The feed system of claim 5, wherein the hopper includes inclined sides to facilitate the passage of comminuted waste materials to the trough.

7. The feed system of claim 6, wherein the hopper includes compressed air jets disposed in the inclined sides to prevent blockage of the hopper

8. The feed system of claim 1, further comprising a means for sterilizing the first and second compartments and the trough.

9. The feed system of claim 1, wherein the trough includes a first and a second end and the feed system further comprises a feed duct including a first and a second end, the first end of the feed duct positioned adjacent the second end of the trough, the first end of the feed duct including a shear edge to cut off any projecting waste material as the material enters the feed duct.

10. The feed system of claim 9, wherein the feed duct is water cooled.

11. The feed system of claim 1, wherein the comminuting means is a rotary shear type shredder.

12. The feed system of claim 9, further comprising an end enclosure disposed adjacent the trough, the end enclosure including a removable cover to facilitate clearing of waste materials.

13. The feed system of claim 1, wherein the feeding means includes an auger disposed in the trough, the auger being movable in the first and second directions.

14. The feed system of claim 1, wherein the feeding means includes a ram slidably disposed in the trough, the ram being movable in the first and second directions.

15. The feed system of claim 1, wherein the means for maintaining negative pressure maintains the negative pressure at about −3 inches water gauge throughout the feed system.

16. An infectious waste feed system for a combustor, the feed system comprising:

a receptacle for accepting waste materials;

mans for comminuting the waste materials to a predetermined size, said comminuting means disposed to comminute waste materials accepted in the receptacle;

a trough disposed to receive the comminuted waste materials;

feeding means disposed within the trough, said feeding means being movable in a first and a second direction within the trough for feeding the comminuted waste materials to the combustor; and a hopper disposed intermediate the comminuting means and the trough for receiving the waste materials comminuted by the comminuting means, the hopper including inclined sides to facilitate the passage of comminuted waste materials to the trough, and compressed air jets disposed in the inclined sides to prevent blockage of the hopper.

17. The feed system of claim 16, further comprising means for sterilizing the receptacle and the trough.

18. An infectious waste feed system for a combustor, the feed system comprising:

a receptacle for accepting waste materials;

means for comminuting the waste materials to a predetermined size, said comminuting means disposed to comminute waste materials accepted in the receptacle;

a trough disposed to receive the comminuted waste materials, the trough having a first end and a second end; and feeding means disposed within the trough, said feeding means being movable in a first and a second direction within the trough for feeding the comminuted waste materials to the combustor; and a feed duct including a first and a second end, the first end of the feed duct positioned adjacent the second end of the trough, the first end of the feed duct including a nonmovable shear edge projecting into the feed duct to cut off any projecting waste material as the material enters the feed duct.

19. The feed system of claim 18, wherein the feed duct is water cooled.

20. The feed system of claim 18, further comprising an end enclosure disposed adjacent the trough, the end enclosure including a removable cover to facilitate clearing of waste materials.

* * * * *

UNITED STATES PATENT AND TRADEMARK OFFICE

CERTIFICATE OF CORRECTION

PATENT NO. : 5,314,127

DATED : May 24, 1994

INVENTOR(S) : E. James Coulthard

It is certified that error appears in the above-identified patent and that said Letters Patent is hereby corrected as shown below:

Claim 16, column 8, line 19, change "mans" to --means--.

Signed and Sealed this

Thirtieth Day of August, 1994

Attest:

Attesting Officer

BRUCE LEHMAN

Commissioner of Patents and Trademarks